US006829974B1

(12) United States Patent
Gwinn, Jr.

(10) Patent No.: US 6,829,974 B1
(45) Date of Patent: Dec. 14, 2004

(54) FIREARM BUFFER SYSTEM

(76) Inventor: Mack W. Gwinn, Jr., P.O. Box 61, Levant, ME (US) 04456

( * ) Notice: Subject to any disclaimer, the term of this patent is extended or adjusted under 35 U.S.C. 154(b) by 0 days.

(21) Appl. No.: 10/733,346

(22) Filed: Dec. 12, 2003

(51) Int. Cl.[7] ..... F41A 19/02
(52) U.S. Cl. ..... 89/130
(58) Field of Search ..... 89/130, 129.01, 89/198

(56) References Cited

U.S. PATENT DOCUMENTS 2,379,461 A * 7/1945 Simpson ..... 89/130
2,900,877 A * 8/1959 McClenahan ..... 89/173
3,366,011 A * 1/1968 Sturtevant ..... 89/198
3,977,296 A * 8/1976 Silsby et al. ..... 89/198
4,056,038 A * 11/1977 Rath ..... 89/128
5,279,202 A * 1/1994 Bellardi et al. ..... 89/198
5,726,377 A * 3/1998 Harris et al. ..... 89/191.01
5,827,992 A * 10/1998 Harris et al. ..... 89/191.01
5,909,002 A * 6/1999 Atchisson ..... 89/130

* cited by examiner

*Primary Examiner*—Teri P. Luu
*Assistant Examiner*—Jordan Lofdahl
(74) *Attorney, Agent, or Firm*—Michael W. York

(57) ABSTRACT

A firearm buffer system that reduces the rate of fire of a full automatic firearm that has a gas port wear and reduces the adverse effect of bolt bounce. The firearm buffer system includes a buffer assembly that has an elongated buffer body having an elongated hollow interior with a dosed end and an open end and a plurality of weights sized and shaped to reciprocate in the elongated hollow interior of the buffer body. Springs are located in the elongated hollow interior of the buffer body for positioning at least some of the weights apart from each other and a movable buffer plunger is reciprocally mounted in the open end of the elongated hollow interior of the buffer body. The movable buffer plunger is sized so that it does not come into operation until a predetermined amount of wear occurs at the firearm's gas port. In one embodiment a spacer member is provided to permit the buffer assembly to be used with a firearm having a full sized buttstock.

11 Claims, 5 Drawing Sheets

FIREARM BUFFER SYSTEM

BACKGROUND OF THE INVENTION

Firearms that can fire automatically are designed so that they have a certain rate of fire. This rate of fire is selected in view of the intended mission or purpose for the firearm and the intended target. Consideration is also given to the intended accuracy, control of the firearm as well as ammunition consumption in selecting the rate of fire. Even though a firearm is designed for a certain rate of automatic fire, the actual rate of fire can change. This rate can be changed through the use of improper ammunition which can easily be cured by switching to the proper ammunition, but it can also change due to other factors that are are not easily cured. Unfortunately, the rate of fire of certain types of firearms can increase with use of the firearm. This usually results in a significant increase in the rate of fire of the firearm which results in undesirable consequences. These consequences can include inaccuracy, unreliable operation, stoppages, jams, struck cartridge cases, and overheating of the firearm.

This increase in the rate of fire due to continued firing of the firearm occurs commonly with certain gas operated firearms. The M-16 type of firearm, which includes the rather current M-4 version, have this increased rate of fire problem. These types of firearms tap the gas from the barrel and pass it back through a gas tube to operate the bolt mechanism. Unfortunately the gas port that taps the gas from the barrel becomes worn as the number of bullets forced through the barrel increases. This wear results in increased gas being ported through the gas tube and this results in an increase in the rate of fire. As a consequence, with time and the increase in the rounds fired and the number of bullets passing through the barrel the user of the firearm ends up with an unreliable firearm or possibly a firearm that is useless. When this occurs, the firearm must betaken out of service and subjected to a major overhaul that commonly will include replacement of the barrel and at least portions of the gas system. This is time consuming and is expensive. Due to this increase in the rate of fire problem, the effective service life of a gas operated firearm is limited. Consequently, a definite need exists to alleviate this increase in the rate of fire problem and to extend the length of the effective service life of the firearm.

There has been one attempt to alleviate this problem as indicated in U.S. Pat. No. 5,909,002. This patent, discloses a firearm buffer assembly that adds an additional moveable portion that is stated to increase the time the buffer assembly is in action and hence reduce the cyclic rate of fire of the associated firearm. However, this arrangement apparently has not been adapted to any extent. Possibly because this arrangement is fairly complex. Therefore, the need still exists for alleviating the increase in the rate of fire problem that does not require any significant alteration or reworking of the firearm so that the, firearm does not need to be withdrawn from service and subjected to undesired modification or reworking that involves significant time and expense.

This invention significantly reduces the rate of fire increase problem. Moreover, this invention not only reduces the rate of fire increase problem, but it also does this without requiring any reworking or modification of the firearm. Instead, all that is necessary is to replace the existing buffer assembly with the buffer assembly of this invention. This is easily accomplished in the field without withdrawing the firearm from service. Also, this replacement is easily accomplished by the user of the firearm without the need for any specifically trained personnel or any detailed instructions.

SUMMARY OF THE INVENTION

This invention relates to firearm buffers and more particularly to firearm buffers that are used with firearms that can be fire full automatically.

It is an object of the invention to provide a firearm buffer system for a firearm that can fire fully automatically that controls the cyclic rate of full automatic fire of the firearm.

It is an object of the invention to provide a firearm buffer system for a firearm that can fire fully automatically that prevents the cyclic rate of automatic fire of the firearm from increasing.

It is an object of the invention to provide a firearm buffer system for a firearm that can fire fully automatically that reduces the cyclic rate of full automatic fire of the firearm when the rate has exceeded the designed cyclic rate of full automatic fire of the firearm.

It is an object of the invention to provide a firearm buffer system for a firearm that can fire fully automatically that compensates for the adverse effects of prolonged full automatic fire of the firearm.

It is an object of the the invention to provide a firearm buffer system for a firearm that can fire fully automatically that compensates for the gas port wear caused by prolonged full automatic fire of the firearm.

It is an object of the invention to provide a firearm buffer system for a firearm that can fire fully automatically that compensates for the early gas port wear that occurs in short barrel full automatic firearms.

It is an object of the invention to provide a firearm buffer system for a firearm that can fire fully automatically that compensates for the early gas port wear that occurs when the gas port is exposed to high pressure erosion during full automatic fire.

It is an object of the invention to provide a firearm buffer system for a firearm that can fire fully automatically that compensates for the adverse effects of prolonged full automatic fire that can be used to retrofit existing firearms.

It is an object of the invention to provide a firearm buffer system for a firearm that can fire fully automatically that compensates for the adverse effects of prolonged full automatic fire that requires no modification to the basic firearm.

It is an object of the invention to provide a firearm buffer system for a firearm that can fire fully automatically that compensates for the adverse effects of prolonged full automatic fire that replaces the current existing firearm buffer.

It is an object of the invention to provide a firearm buffer system for a firearm that can fire fully automatically that compensates for the adverse effects of prolonged full automatic fire that is an easy replacement for the current existing firearm buffer.

It is an object of the invention to provide a firearm buffer system for a firearm that can fire fully automatically that compensates for the adverse effects of prolonged full automatic fire that replaces the current existing firearm buffer without the use of any tools.

It is an object of the invention to provide a firearm buffer system for a firearm that can fire fully automatically that compensates for the adverse effects of prolonged full automatic fire that replaces the current existing firearm buffer that does not require any special training for the replacement.

It is an object of the invention to provide a firearm buffer system for a firearm that can fire fully automatically that compensates for the adverse effects of prolonged full automatic fire that replaces the current existing firearm buffer that does not require the withdrawal of the firearm from service.

It is an object of the invention to provide a firearm buffer system for a firearm that can fire fully automatically that compensates for the adverse effects of prolonged full automatic fire that replaces the current existing firearm buffer that can be replaced by the user of the firearm.

It is an object of the invention to provide a firearm buffer system for a firearm that can fire fully automatically that compensates for the adverse effects of prolonged full automatic fire that does not adversely effect the operation of the firearm.

It is an object of the invention to provide a firearm buffer system for a firearm that can fire fully automatically that compensates for the adverse effects of prolonged full automatic fire that does not adversely effect semiautomatic operation of the firearm.

It is an object of the invention to provide a firearm buffer system for a firearm that can fire fully automatically that compensates for the adverse effects of prolonged full automatic fire that permits the use of a wider range of types of ammunition.

It is an object of the invention to provide a firearm buffer system for a firearm that can fire fully automatically that compensates for the adverse effects of prolonged full automatic fire that increases the reliability of the firearm.

It is an object of the invention to provide a firearm buffer system for a firearm that can fire fully automatically that compensates for the adverse effects of prolonged full automatic fire that prevents or reduces jamming of the firearm.

It is an object of the invention to provide a firearm buffer system for a firearm that can fire fully automatically that compensates for the adverse effects of prolonged full automatic fire that prevents cartridge cases sticking in the chamber of the firearm.

It is an object of the invention to provide a firearm buffer system for a firearm that can fire fully automatically that compensates for the adverse effects of prolonged full automatic fire that prevents damage to the firearm.

It is an object of the invention to provide a firearm buffer system for a firearm that can fire fully automatically that compensates for the adverse effects of prolonged full automatic fire that prevents breakage of firearm parts.

It is an object of the invention to provide a firearm buffer system for a firearm that: can fire fully automatically that compensates for the adverse effects of prolonged full automatic fire that is not temperature sensitive.

It is an object of the invention to provide a firearm buffer system for a firearm that can fire fully automatically that compensates for the adverse effects of prolonged full automatic fire that is maintenance free.

It is an object of the invention to provide a firearm buffer system for a firearm that can fire fully automatically that compensates for the adverse effects of prolonged full automatic fire that does not wear out.

It is an object of the invention to provide a firearm buffer system for a firearm that can fire fully automatically that compensates for the adverse effects of prolonged full automatic fire that is simple in its operation.

It is an object of the invention to provide a firearm buffer system for a firearm that can fire fully automatically that compensates for the adverse effects of prolonged full automatic fire that has a dual function.

It is an object of the invention to provide a firearm buffer system for a firearm that can fire fully automatically that compensates for the adverse effects of prolonged full automatic-fire that also prevents or reduces bolt or bolt carrier bounce.

It is an object of the invention to provide a firearm buffer system for a firearm that can fire fully automatically that compensates for the adverse effects of prolonged full automatic fire that also uses live weights to prevent or reduce bolt or bolt carrier bounce.

It is an object of the invention to provide a firearm buffer system for a firearm that can fire fully automatically that compensates for the adverse effects of prolonged full automatic fire that also uses live weights positioned for metal to metal impact to prevent or reduce bolt or bolt carrier bounce.

It is an object of the invention to provide a firearm buffer system for a firearm that can fire fully automatically that compensates for the adverse effects of prolonged full automatic fire that also uses live weights positioned by springs for metal to metal impact to prevent or reduce bolt or bolt carrier bounce.

It is an object of the invention to provide a firearm buffer system for a firearm that can fire fully automatically that reduces muzzle climb when fired fully automatically.

It is an object of the invention to provide a firearm buffer system for a firearm that can fire fully automatically that is particularly useful for M-16 type firearms.

It is an object of the invention to provide a firearm buffer system for a firearm that can fire fully automatically that is particularly useful for various versions of M-16 type firearms.

It is an object of the invention to provide a firearm buffer system for a firearm that can fire fully automatically that is useful for various versions of M-16 type firearms having different buttstock configurations.

It is an object of the invention to provide a firearm buffer system for a firearm that can fire fully automatically that is useful for various versions of M-16 type firearms having different buttstock configurations including the fixed buttstock version.

It is an object of the invention to provide a firearm buffer system for a firearm that can fire fully automatically that is useful for various versions of M-16 type firearms having different buttstock configurations including the carbine version.

These and other objects of the invention will be apparent from the following description of the firearm buffer system invention that includes a buffer assembly that has an elongated buffer body having an elongated hollow interior with a closed end and an open end, a plurality of weights sized and shaped to reciprocate in the elongated hollow interior of the buffer body, resilient means located in the elongated hollow interior of the buffer body for positioning at least some of the weights apart from each other and a movable buffer plunger reciprocally mounted in the open end of the elongated hollow interior of the buffer body. The buffer assembly has rate of full automatic fire control means for controlling the firearm rate of full automatic fire that is designed so that it does not operate until a predetermined high rate of fire is reached due to excessive erosion of the gas port of the firearm or from some other cause such as improper ammunition. In one embodiment a spacer member is provided to allow the buffer assembly to be used with a full sized fixed buttstock.

BRIEF DESCRIPTION OF THE DRAWINGS

The invention will be hereinafter more fully described with reference to the accompanying drawings in which.

DETAILED DESCRIPTION OF THE PREFERRED EMBODIMENTS

Figure 1:
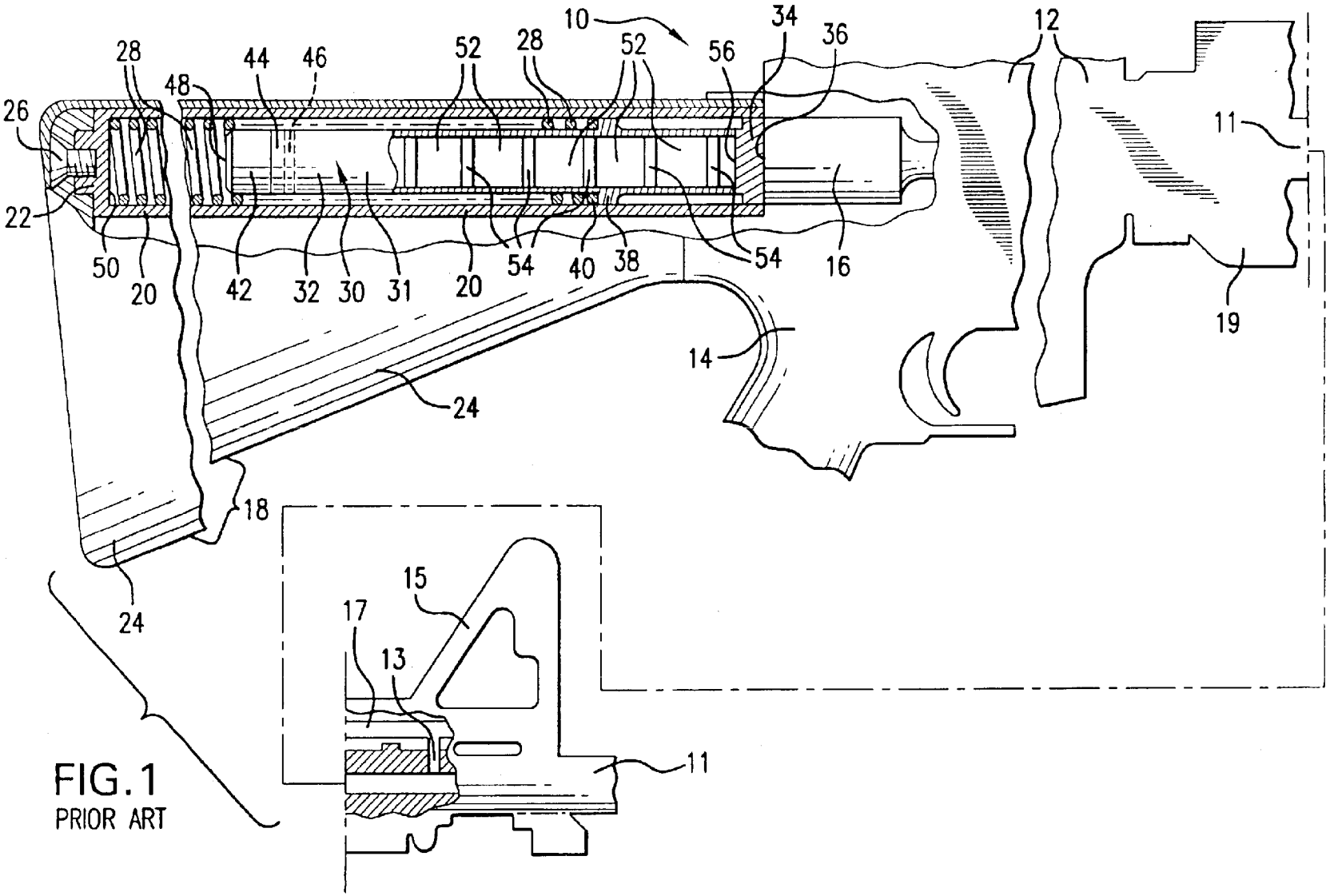
FIG. 1 PRIOR ART
FIG. 1 is a side elevational view of a portion of an M-16 type firearm with a prior art buffer with portions broken away.

FIG. 1 illustrates a portion of a standard prior art M-16 type firearm that is designated generally by the number 10. This M-16 type firearm 10 has a standard upper and lower receiver 12 and 14 with a standard bolt carrier 16 located in the upper receiver 12. As illustrated in FIG. 1 along with FIG. 2, a conventional barrel 11 extends from the upper receiver 12 and the barrel 11 has a conventional gas port 13 and a conventional front sight assembly 15 is connected to the barrel 11. In addition, a conventional gas tube 17 is operatively connected to the gas port 13 and a conventional hand guard assembly 19 surrounds a portion of the barrel 11. A conventional buttstock assembly 18 is also connected to the lower receiver 14. This assembly 18 has a conventional hollow receiver extension tube 20 that has its rear portion 22 connected to the buttstock 24 by the screw 26. The hollow receiver extension tube 20 contains a conventional recoil spring 28 and a conventional buffer 30.

The buffer 30 has a generally tubular hollow buffer body 32 with a closed forward enlarged end portion 34 that contacts the rear portion 36 of the bolt carrier 16. This conventional buffer body 32 is sized and shaped for reciprocal movement within the hollow receiver extension tube 20. The conventional buffer body 32 is made from a light weight aluminum alloy. This buffer body 32 has an enlarged flange portion 38 that contacts and serves as a seat for the forward portion 40 of the recoil spring 28 that surrounds the rearward portion 31 of the buffer body 32.

A plastic bumper 42 is located in the open aft end portion 44 of the buffer body 32. This bumper 42 is secured in place within the aft end portion 44 of the buffer body 32 by the pin 46 so that a rear bumper portion 48 extends outward beyond the aft end portion 44 of the buffer body 30. This rear bumper portion 48 strikes the rear interior surface 50 of the receiver extension 20 when the buffer 30 is in the full recoil position.

As illustrated in FIG. 1, five identical weights 52 are located within the hollow interior of the buffer body 32 and there are identical resilient washers 54 located between adjacent weights 52 and between the forward weight 52 and the closed end 56 of the hollow interior of the buffer body 32. The weights 52 and the resilient washers 54 are sized so that they are free to move within the hollow interior of the buffer body 32. Due to the inertia of the weights 52 as the buffer 30 moves into the battery position, the weights provide a force that is intended to prevent bolt or bolt carrier 16 bounce and hence cut down on possible bolt bounce misfires.

FIGS. 3 through 6 illustrate one embodiment of the firearm buffer system invention that is designated generally by the number 57 that comprises a buffer assembly 58 and a spacer 59 and the firearm buffer system invention 57 is illustrated as it would be installed in the same conventional M-16 type firearm 10 illustrated in FIG. 1 in place of the conventional buffer 30. The buffer assembly 58 includes a generally tubular hollow buffer body 60 with a closed forward enlarged end portion 62 that contacts the rear portion 36 of the bolt carrier 16. this buffer body 60 is sized and shaped for reciprocal movement within the hollow receiver extension tube 20. The buffer body 60 is made from steel rather than a light weight aluminum alloy as is the prior art buffer body 32. The enlarged end portion 62 of the buffer body 60 serves as a seat for the forward portion 40 of the recoil spring 28 that surrounds the outer surface of the buffer body 60. The buffer assembly 58 also includes a plastic plunger bumper 64 reciprocally located in the open aft end portion 66 of the buffer body 60. This plunger bumper 64 is secured into place for reciprocal movement within the rearward portion 66 of the buffer body 60 by a pin 68 that fits through a slot 70 in the plunger bumper 64 so that an enlarged tapered rear bumper portion 72 extends outward beyond the aft end portion 74 of the buffer body 60. Under certain circumstances, that will be hereinafter described, the flat rear plunger bumper portion 76 strikes a portion of the spacer 59 or the rear surface 50 of the receiver extension 20 when the buffer body 60 is in the full recoil position.

The buffer assembly 58 also includes three solid cylindrical tungsten weights 78, 80 and 82 located within the hollow interior 84 of the buffer body 60. These weights 78, 80, and 82 are each cylindrical shaped and have the same exterior dimensions and they are sized and shaped for reciprocal movement within the hollow interior 84 of the buffer body 60 when the plunger bumper 64 is secured in place by the pin 68 with part of its smaller diameter cylindrical portion 86 located in the aft portion 66 of the interior 84 of the buffer body 60. The two weights 80 and 82 that are separated from the plunger bumper 64 by the weight 78 have respective identical circular cross section cylindrical blind holes 88 and 90 that centrally are located in the respective surfaces 92 and 94 of the weights 80 and 82 that face toward the enlarged end portion 62 of the buffer body 60. These cylindrical holes 88 and 90 extend to a depth approximately equal to ⅔ of the length of the weights 80 and 82. A coil compression spring 96 has a portion thereof located within the hole 88 and another coil compression spring 98 has a portion thereof located within the hole 90 in the weight 82. One end 100 of the coil spring 96 pushes against the bottom surface 102 of the hole 88 and the other end 104 of the spring 96 pushes against the surface 106 of the weight 82.

In a similar manner, one end 108 of the coil spring 98 pushes against the bottom surface 110 of the hole 90 and the other end 112 pushes against the surface 114 of the hollow interior of the buffer body 60. The coil spring 98 is longer and stronger than the coil spring 96 and this keeps the weights 80 and 82 spread apart and apart from the surface 114 within the hollow interior of the buffer body 60. The purpose of these springs 96 and 98 is to maintain the weights 80 and 82 separated apart within the hollow interior of the buffer body 60. The length of the slot 70 is substantially 0.325 of an inch and this permits the plunger bumper 64 to move inward into the aft end portion 74 of the buffer body 60 for up to 0.20 of an inch in the preferred embodiment.

Figure 3:
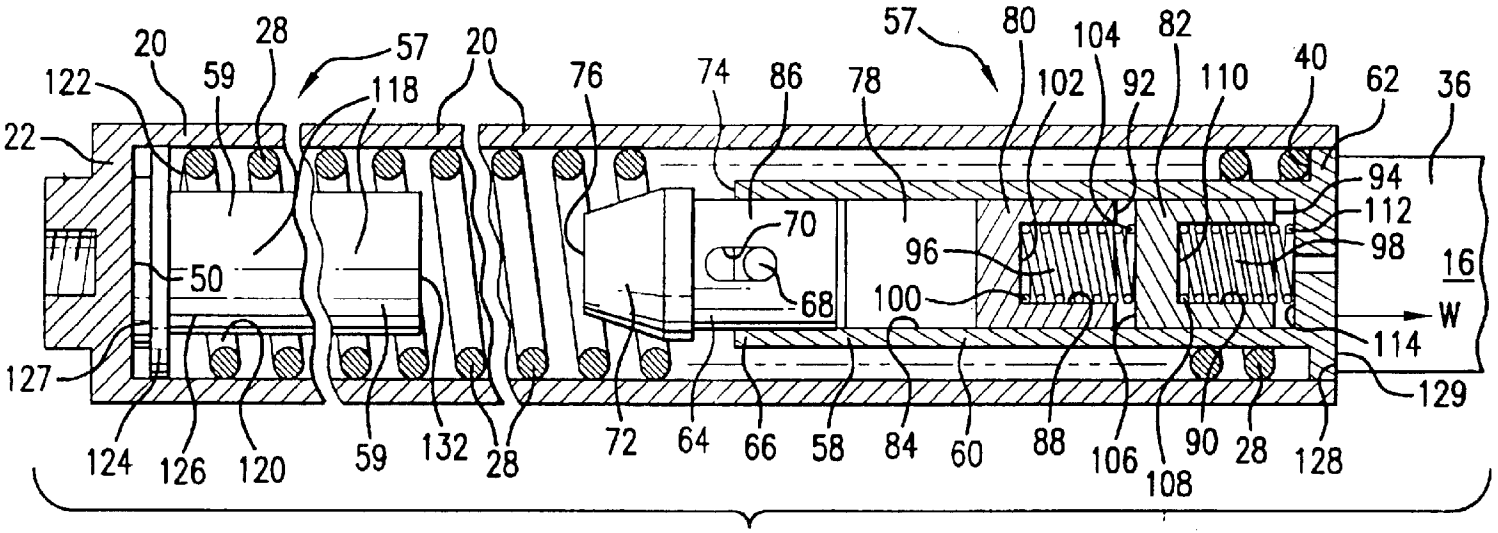
FIG. 3 is a side elevational view of a portion of the M-16 type firearm set forth in FIG. 1 with the conventional buffer replaced by one embodiment of the firearm buffer system invention with portions broken away with the buffer assembly in the battery or forward position.
Figure 4:
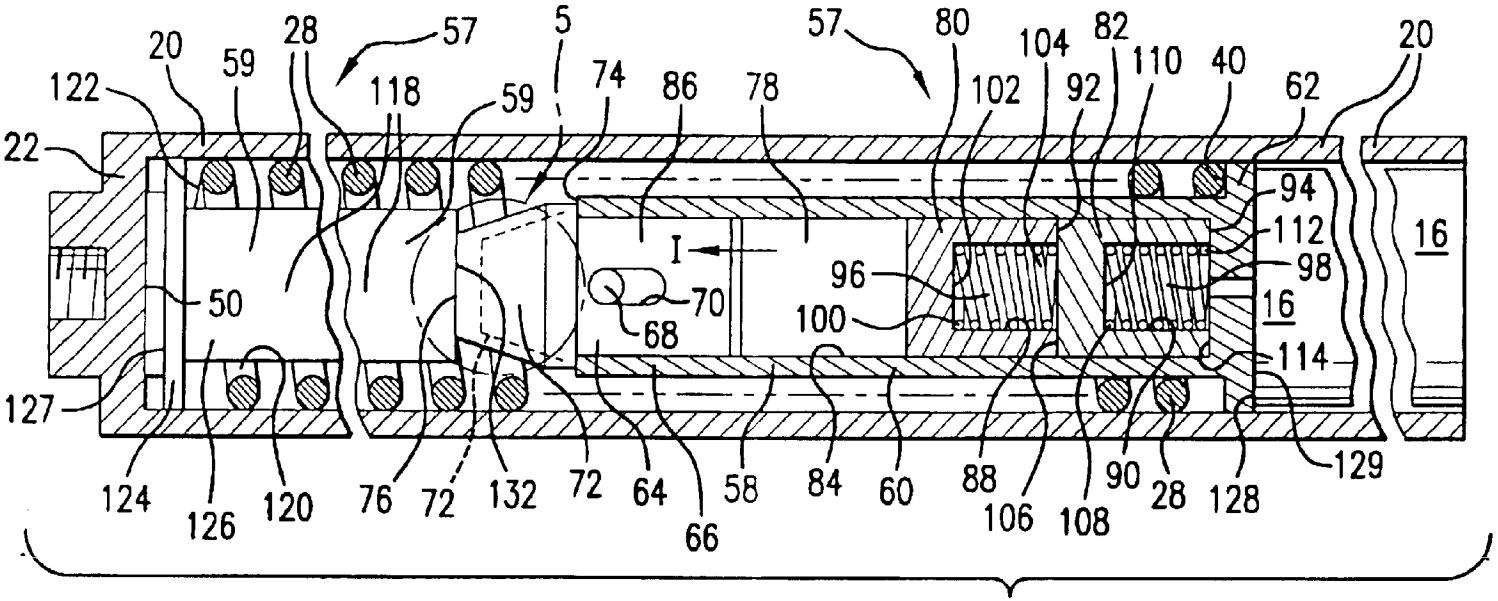
FIG. 4 is a side elevational view of the M-16 type firearm structure set forth in FIG. 3 with one embodiment of the firearm buffer system invention with portions broken away with the buffer assembly shown in the full recoil position.
Figure 6:
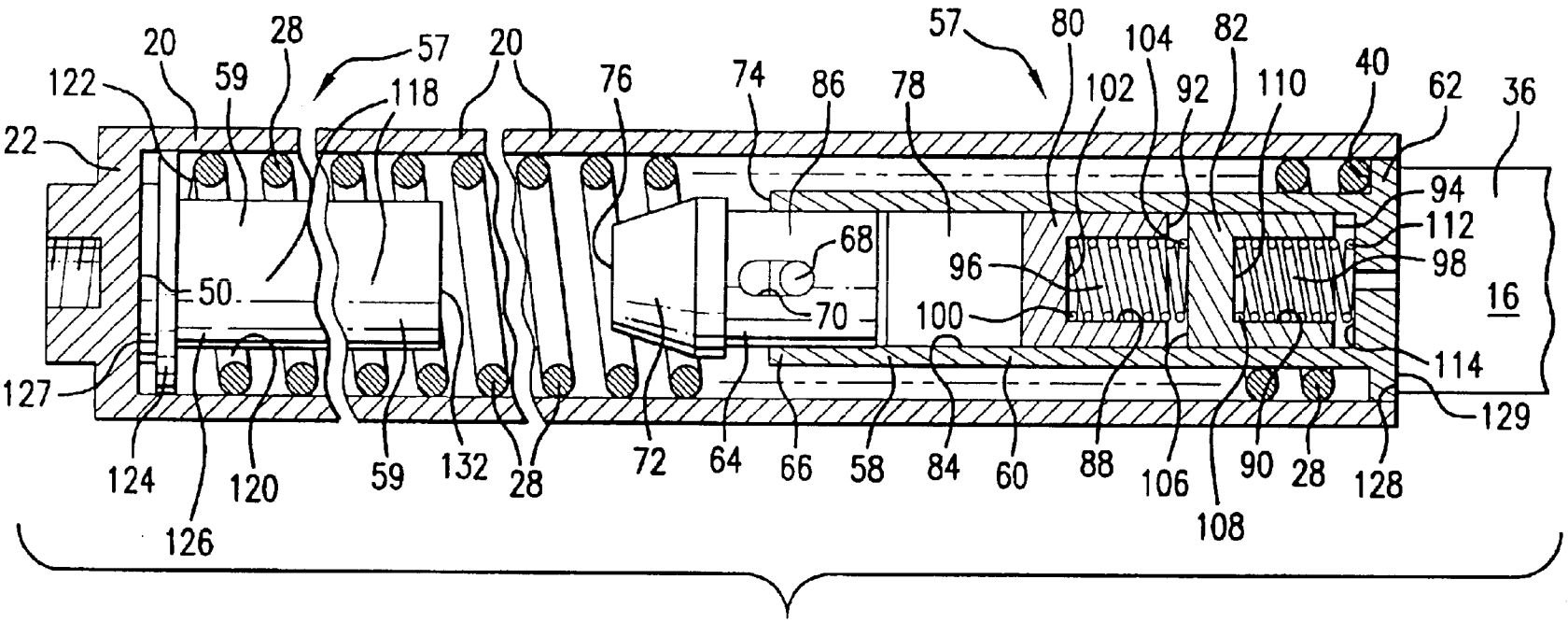
FIG. 6 is a side elevational view of the M-16 type firearm structure set forth in FIGS. 3 and 4 with one embodiment of the firearm buffer system invention with portions broken away as the buffer assembly is returning to the battery position during full automatic firing.

The buffer system 57 also includes another very important component of the invention that is necessary for the standard full size M-16 type buttstock. This important component of the firearm buffer system 57 is the spacer member 59 that comprises a generally cylindrical shaped plastic elongated member that has a uniform cylindrical body portion 118 that is sized and shaped to slide into the interior 120 of the aft end portion 122 of the conventional M-16 type recoil spring 28. This spacer member 59 has an enlarged circular radial flange 124 near its aft end 126 and the spacer member 59 also has a reduced diameter short cylindrical portion 127 at its aft end. As indicated in FIGS. 3, 4 and 6, the cylindrical body portion 118 of this spacer member 59 fits into the interior 120 of the aft end portion 122 of the conventional recoil spring 28 and the flange 124 contacts the aft end portion 122 of the recoil spring 28 and this prevents the spacer member 59 from sliding forward into the interior 120 of the recoil spring 28. This spacer member 59 contracts the plunger bumper 64 and permits it to function in a manner that will hereinafter be described in detail.

The manner in which the buffer system invention 57 functions will be described by referring sequentially to FIGS. 3 through 6. In FIG. 3, the firearm buffer assembly 58 is illustrated in the battery position or the position it would be at when the M-16 type firearm 10 is ready to fire with the bolt carrier in 16 located in its forward position. In this position, the end surface 129 of the buffer body 60 that has the enlarged end portion 62 rests against the rear surface 128 of the bolt carrier 16 in a manner similar to that for the conventional buffer 30 illustrated in FIG. 1. When the M-16 type firearm 10 is fired the bolt carrier 16 will move toward the rear of the firearm 10 and into the hollow receiver extension tube 20 in a conventional manner and since the rear surface 128 of the bolt carrier 16 is in contact with the end surface 129 of the buffer body 60, the bolt carrier 16 will push the buffer assembly 58 toward the rear portion 22 of the hollow receiver extension tube 20. However, since the buffer body 60 is made from steel and since there are three tungsten weights 78, 80 and 82 located inside the buffer body 60, the recoiling bolt carrier 16 will have to overcome the extra amount of inertia caused by this additional weight, identified by W and an arrow in FIG. 3 that works against the rearward movement of the bolt carrier 16 and this will cause a delay in rearward recoil movement of the bolt carrier 16 and hence contribute to a decrease in the cyclic rate of fire of the firearm 10. When the inertia represented by W of the buffer assembly 58 is overcome, the buffer assembly 58 will be pushed into the hollow receiver extension tube 20 and at the same time the recoil spring 28 will be compressed.

Figure 2:
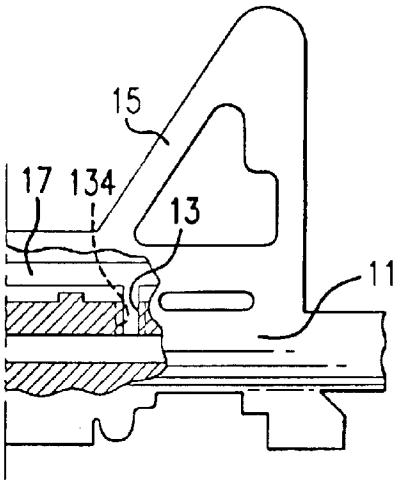
FIG. 2 is an enlarged view of a portion of the structure set forth in FIG. 1 illustrating gas port wear due to prolonged full automatic firing of the firearm.
Figure 5:
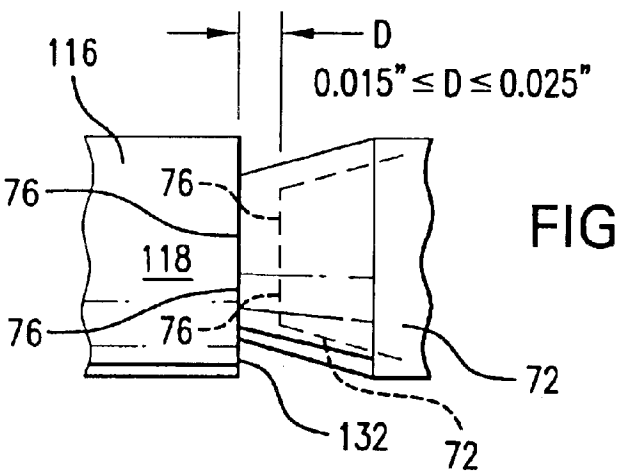
FIG. 5 is an enlarged view of a portion of the structure illustrated in FIG. 4 taken within the circle 5 thereof.

As the recoil movement of the bolt carrier 16 continues it will reach its full recoil position and at the same time the adjacent buffer assembly 58 will also be the full recoil position which is illustrated in FIG. 4 and in FIG. 5 the enlarged view of a portion of FIG. 4. Actually, there are various possible recoil positions for the buffer assembly 58 and two of these are illustrated in FIGS. 4 and 5 where two positions of the plunger bumper 64 of the buffer assembly 58 are illustrated. The position of the buffer assembly 58 within the hollow receiver extension tube 20 depends upon the condition of the gas port 13 of the barrel 11 that is best illustrated in FIG. 2 that shows the unworn or new gas port in solid lines 13 and the badly worn gas port in dashed lines 134 that has been enlarged in FIG. 2 for clarity. The position of a portion of the buffer assembly 58 in the full recoil position when the firearm has a normal substantially unworn gas port 13 is illustrated in dashed lines in FIGS. 4 and 5. As indicated by the dashed lines in FIG. 4 and also in greater detail in FIG. 5, the outer end 76 of the plunger bumper 64 does not come into contact with the outer end 132 of the cylindrical body portion 118 of the spacer member 59. Instead, as indicated, there is a distance represented by the letter D between the outer end 76 of the plunger bumper 64 and the outer end 132 of the cylindrical body portion 118 of the spacer member 59. This distance should be between 0.015 and 0.025 of an inch or the equivalent in metric units. In the preferred embodiment the distance D is 0.020 of an inch or the metric equivalent. Both the spacer member 59 and the buffer assembly 58 are designed and sized to achieve this desired distance D that is critical for the proper functioning of the firearm buffer system invention 57 in reducing the high rate of fire of the firearm when the gas port becomes excessively worn as illustrated for the worn gas port 134 in FIG. 2.

When the gas port 13 of the firearm 10 becomes excessively worn as illustrated in FIG. 2 by the number 134, this increases the amount of gas passing through the gas tube 17 and impinging upon the bolt carrier 16. This results in increased energy being imparted to the bolt carrier 16 that is in turn imparted to the buffer assembly 58. This increased energy results in the buffer assembly 58 moving further into the receiver extension tube 20 when the buffer assembly 58 is in the full recoil position which is indicated in FIGS. 4 and 5 by the full lines of the plunger bumper 64 of the buffer assembly 58. As illustrated in FIGS. 4 and 5, in solid lines associated with the position due to the worn gas port 134, the outer end 76 of the plunger bumper 64 comes into contact with the outer end 132 of the cylindrical body portion 118 of the spacer member 59. When this occurs, the buffer assembly 58 continues to move in recoil due to the gases passed through the worn gas port 134 since the plunger bumper 64 is movable into the buffer body 60. This additional movement due to the movable plunger member 64 into the buffer body 60 adds time to the recoil cycle that would not be present if the plunger bumper 64 was fixed to the buffer body 60 of the bumper assembly 58. In addition, inward movement of the plunger bumper 64 into the buffer body 60 of the buffer assembly 58 is resisted by the inertia I of the heavy tungsten weights 78, 80 and 82 and this also adds an additional amount of time to the recoil cycle that would not be present if the plunger bumper 64 was not movable and if the heavy tungsten weights 78, 80, and 82 were not present FIG. 6 illustrates the firearm buffer system 57, set forth previously in FIGS. 3 through 5, as the buffer assembly 58 is returning to the battery or firing position. As indicated previously, as the bolt carrier 16 of the M-16 type firearm 10 goes into the battery or firing position it has a tendency to bounce or move backward slightly after it hits its fully seated position. This causes problems by producing misfires. However, with this buffer assembly 58 this problem is alleviated since the spaced apart tungsten weights 78, 80 and 82 impart successive forward blows to the buffer body 60 that are in turn transmitted to the bolt carrier 16 that overcome or counteract any rearward bolt carrier 16 bounce movements or movements of the bolt carrier 16 toward the buffer assembly 58. The fact that the weights 78, 80 and 82 are made from tungsten also increases their effectiveness since they impart significant blows to the bolt carrier 16 due to their weight. The springs 96 and 98 are important since they maintain the weights 80 and 82 in a separated relationship and this results in successive blows being transmitted to the bolt carrier 16 rather than just one. Moreover, the use of plastic spacers 54 between the weights in the prior art buffer 30 as illustrated in FIG. 1 has been eliminated and this results in sharp un-cushioned blows by the weights 78, 80 and 82 to the bolt carrier 16 that impart significantly more effective blows to the bolt carrier 16 than the prior art cushioned blows.

Figure 7:
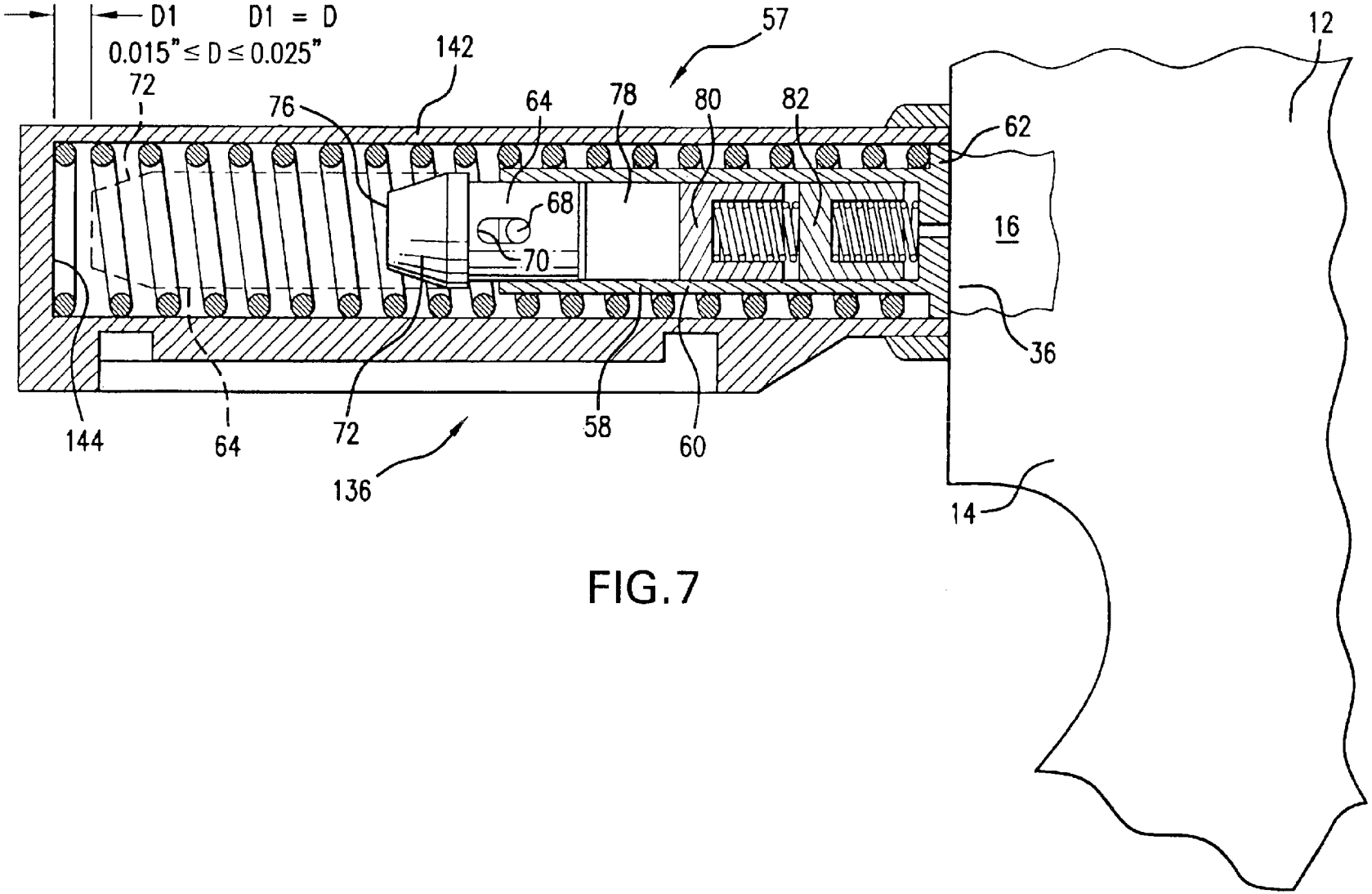
FIG. 7 is a side elevational view of a portion of an M-16 carbine type firearm with another embodiment of the firearm buffer system invention with portions broken away.

FIG. 7 illustrates the carbine version of the M-16 firearm that is designated generally by the number 136. The M-16 carbine firearm 136 is the same as the previously described M-16 type firearm 10 except that it has a different receiver extension 142 and a different buttstock assembly that is collapsable that has been omitted for clarity since it is conventional and not necessary for a proper understanding of the invention. The hollow receiver extension 142 of the M-16 carbine 136 is shorter than the receiver extension 20 of the previously described M-16 type firearm 10. In view of the shorter receiver extension 142 a slightly modified firearm buffer system invention 57 is used with this M-16 carbine 136. With this firearm buffer system invention 57 in FIG. 7, all that is required for the M-16 carbine 136 is to omit the use of the spacer 59. With the spacer 59 omitted, the buffer assembly 58 cooperates directly with the rear inside surface 144 of the receiver extension 142 of the M-16 carbine 136 as if the surface 144 was the same as the outer end 132 of the cylindrical body portion 118 of the spacer member 59.

In this connection, the buffer assembly plunger bumper 64 is illustrated in dashed lines in FIG. 7 in the full recoil position with an unworn gas port 13 and the same distance D1 is present between the surface 144 and the outer end 76 of the plunger bumper 64 as the distance D between the outer end 76 of the plunger bumper 64 and the outer end 132 of the cylindrical body portion 118 of the spacer member 59. As indicated previously, this distance D1 should be between 0.015 and 0.025 of an inch or the equivalent in metric units. In the preferred embodiment the distance D1 is 0.020 of an inch or the metric equivalent. The buffer assembly 58 is suitably sized to achieve this desired distance D1 that is critical for the proper functioning of the buffer invention 58 in reducing the high rate of fire of the firearm when the gas port becomes excessively worn as illustrated for the worn gas port 134 in FIG. 2.

The function of the buffer assembly 58 in the M-16 carbine 136 is exactly the same as with the previously described M-16 type firearm 10 as described with respect to FIGS. 3 through 6. The only difference is that the shorter receiver extension 142 eliminates the need for the spacer 59 and the surface 144 of the shorter receiver extension 142 takes the place of the spacer member 59 end surface 132.

Although the invention has been described in considerable detail with reference to certain preferred embodiments, it will be understood that variations or modifications may be made within the spirit and scope of the invention as defined in the appended claims.

What is claimed is:

1. A firearm buffer system for a firearm capable of full automatic fire and having a cyclic rate of full automatic fire with a buffer recoil time associated with each buffer recoil cycle and having a gas port subject to wear comprising an elongated buffer body having an elongated hollow interior with a closed end and an open end, and cyclic rate of fire reducing means comprising two forms of cyclic rate of fire reducing means at least partially located within the elongated hollow interior of the elongated buffer body, one of the two forms of cyclic rate of fire reducing means comprising a plunger bumper member reciprocally mounted in the open end of the elongated hollow interior of the elongated buffer body for increasing the length of travel of the buffer during a buffer recoil cycle and increasing the buffer recoil time associated with each buffer recoil cycle and means for keeping the plunger bumper member inactive until the gas port of the firearm becomes worn to a predetermined degree.

2. The firearm buffer of claim 1 wherein the other of the two forms of cyclic rate of fire reducing means comprises weight means for adding inertia.

3. The firearm buffer of claim 2 wherein the weight means comprises a plurality of weights.

4. The firearm buffer of claim 3 wherein the plurality of weights comprise tungsten weights.

5. The firearm buffer of claim 3 further comprising separating means located between at least some of the plurality of weights for separating at least some of the plurality of weights.

6. The firearm buffer of claim 5 wherein the separating means comprise springs located between at least some of the plurality of weights.

7. The firearm buffer of claim 6 wherein at least some of the weights have holes and wherein the springs located between at least some of the plurality of weights are at least partially located in the holes.

8. The firearm buffer of claim 1 wherein the plunger bumper member has a full recoil position and wherein the means for keeping the plunger bumper member inactive until the gas port of the firearm becomes worn to a predetermined degree comprises means for requiring the plunger bumper member to move in the full recoil position a certain distance to function.

9. The firearm buffer of claim 8 wherein the means for requiring the plunger bumper member to move in the full recoil position a certain distance to function includes a spacer member for contacting the plunger bumper member and permitting the plunger bumper member to function.

10. The firearm buffer of claim 8 wherein the plunger bumper member has a slot and further comprising a member located at least partially in the slot for reciprocally mounting the plunger bumper member in the open end of the elongated hollow interior of the elongated buffer body.

11. The firearm buffer of claim 10 wherein the member located at least partially in the slot in the plunger bumper member for reciprocally mounting the plunger bumper member in the open end of the elongated hollow interior of the elongated buffer body comprises a pin.

* * * * *